US006936216B2

(12) United States Patent
Kojo et al.

(10) Patent No.: US 6,936,216 B2
(45) Date of Patent: Aug. 30, 2005

(54) MELT LAUNDER

(75) Inventors: Ilkka Kojo, Kirkkonummi (FI); Ari Jokilaakso, Espoo (FI)

(73) Assignee: Outokumpu Technology Oy, Espoo (FI)

( * ) Notice: Subject to any disclaimer, the term of this patent is extended or adjusted under 35 U.S.C. 154(b) by 0 days.

(21) Appl. No.: 10/492,988

(22) PCT Filed: Oct. 8, 2002

(86) PCT No.: PCT/FI02/00786

§ 371 (c)(1),
(2), (4) Date: Apr. 16, 2004

(87) PCT Pub. No.: WO03/033982

PCT Pub. Date: Apr. 24, 2003

(65) Prior Publication Data

US 2004/0245684 A1 Dec. 9, 2004

(30) Foreign Application Priority Data

Oct. 19, 2001 (FI) ..... 20012024

(51) Int. Cl.[7] ..... C21B 7/14
(52) U.S. Cl. ..... 266/196; 266/231; 266/241
(58) Field of Search ..... 266/196, 231, 266/241

(56) References Cited

U.S. PATENT DOCUMENTS

| | | | | |
|---|---|---|---|---|
| 1,502,272 A | * | 7/1924 | Sayre et al. | 193/2 R |
| 4,097,679 A | | 6/1978 | Fukumoto et al. | 13/32 |
| 4,177,974 A | * | 12/1979 | Higuchi et al. | 266/196 |
| 4,426,067 A | * | 1/1984 | Hopkins | 266/196 |
| 5,346,182 A | | 9/1994 | Kurotobi et al. | 266/78 |

FOREIGN PATENT DOCUMENTS

| | | |
|---|---|---|
| JP | 9-95709 | 4/1997 |
| JP | 2000319712 | 11/2000 |
| JP | 3265148 | 3/2002 |
| SE | 419373 | 7/1981 |
| WO | WO 99/36580 | 7/1999 |
| WO | WO 00/53986 | 9/2000 |

* cited by examiner

*Primary Examiner*—Scott Kastler
(74) *Attorney, Agent, or Firm*—Morgan & Finnegan, LLP

(57) ABSTRACT

The invention relates to a melt launder (1, 9, 10) comprising a bottom and edged, said melt launder being particularly meant to be used for tapping a molten phase, such as slag, from a smelting furnace, which melt launder is manufactured of copper or copper alloy and provided with cooling channels (8), so that at the bottom (2) of the melt launder (1, 9, 10), there is arranged at least one groove (3).

10 Claims, 2 Drawing Sheets

MELT LAUNDER

Figure 1:
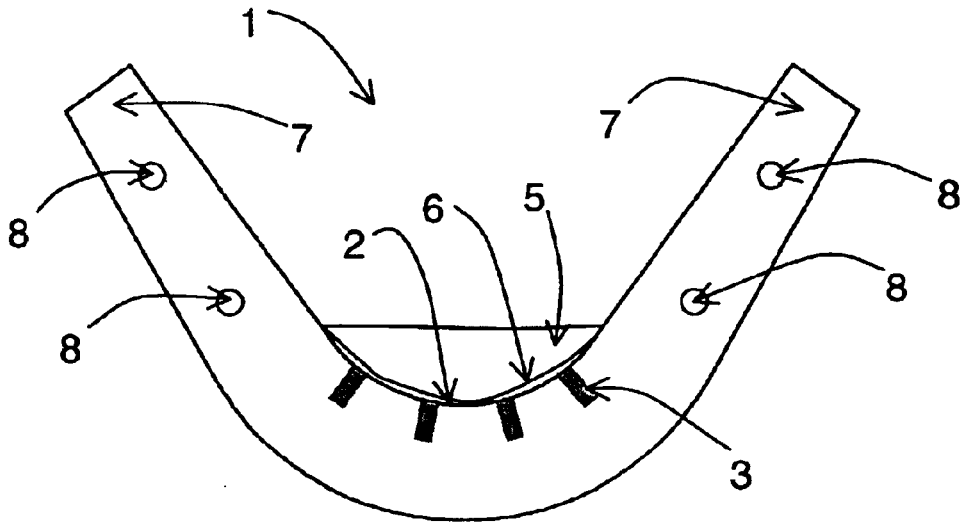

The present invention relates to a melt launder, in particular, a melt launder for tapping a molten phase, such as slag, from a smelting furnace. The melt launder is made of copper or copper alloy and is provided with cooling piping at the edges.

For tapping a molten phase such as slag from a smelting furnace, there are often used copper launders, either water-cooled or uncooled launders. The temperature of the melt is very high when it is tapped out of the furnace. When tapping melt from the furnace, an amount of somewhat solidified slag also enters the launder, and this solidified slag protects the launder against damages caused by the heat, such as heat expansion. However, at the beginning of the tapping step, the launder surface facing the molten slag is often heated up to a high temperature before the slag is solidified, which may cause damages in the launder. There are often used melt launders provided with cooling piping that which protects the launder against damages.

From the publication JP-A-7305966, there is known the method of drilling water channels in the launder in order to prevent transformation damages. The water channels are arranged in the launder so that they protect the whole launder housing. Also from the publication FI 990513 there is known a launder that is provided with cooling piping at the edges.

However, generally it is not desirable to increase the cooling for repairing launder damages, because in copper smelting, in connection with tapping melt, such as slag, this may result in that also molten copper is tapped, and as a result blister copper enters the cooling piping and causes an explosion.

The object of the invention is to achieve a melt launder whereby the prior art drawbacks are avoided. According to the present invention, there is developed a melt launder where the bottom that is in contact with the melt is provided with grooves, and the grooves are filled with fire-resistant material that is in the course of time naturally replaced with slag. Said material protects the launder against possible transformation damages at the beginning of the tapping step. Above the molten surface, the melt launder edges are provided with cooling water channels that are arranged so that water does not in any case get into contact with the melt.

The melt launder according to the invention advantageously prevents melt launder damages created in connection with the tapping of a molten phase, such as slag, particularly at the beginning of the tapping step. The grooves provided according to the invention at the launder bottom are filled with fire-resistant material that endures high temperatures. The fire-resistant mass located on the launder bottom advantageously protects the launder bottom against wearing. By using the melt launder according to the invention, there is achieved a longer working life for the launder, which also means savings in the expenses. Another advantage of the invention is that when the fire-resistant mass is detached, it is autogenously replaced by slag.

At the bottom of the melt launder according to the invention, there is arranged a required number of grooves proceeding in the lengthwise direction thereof, said grooves ending at both launder ends in a transversal groove. Said transversal groove extends from one launder edge to the other. The depth of the lengthwise groove may advantageously vary within the range of 5–25 millimeters, and its width may advantageously vary within the range of 5–25 millimeters, depending on the size of the melt launder. The distance between the lengthwise grooves may advantageously vary between 5–25 millimeters. The lengthwise groove must be placed at a given distance from the cooling water pipings located at the launder edges. Said distance is advantageously at least 30 millimeters.

The invention is described in more detail below with reference the appended drawings.

Figure 2:
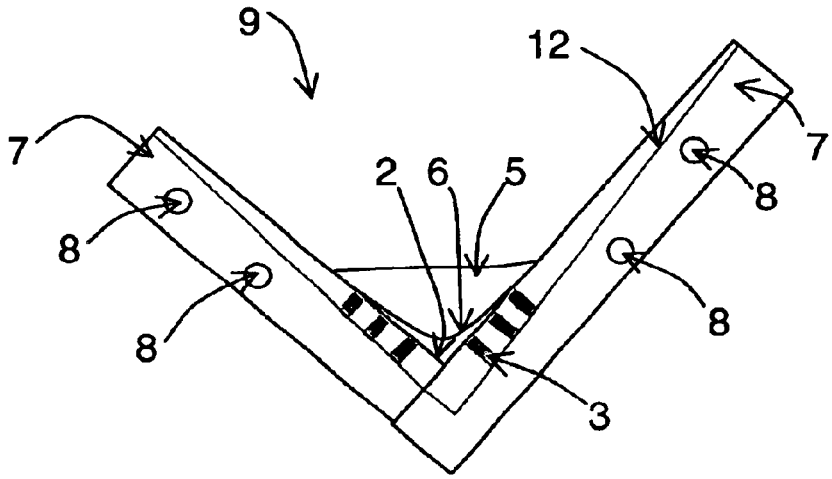
Figure 3:
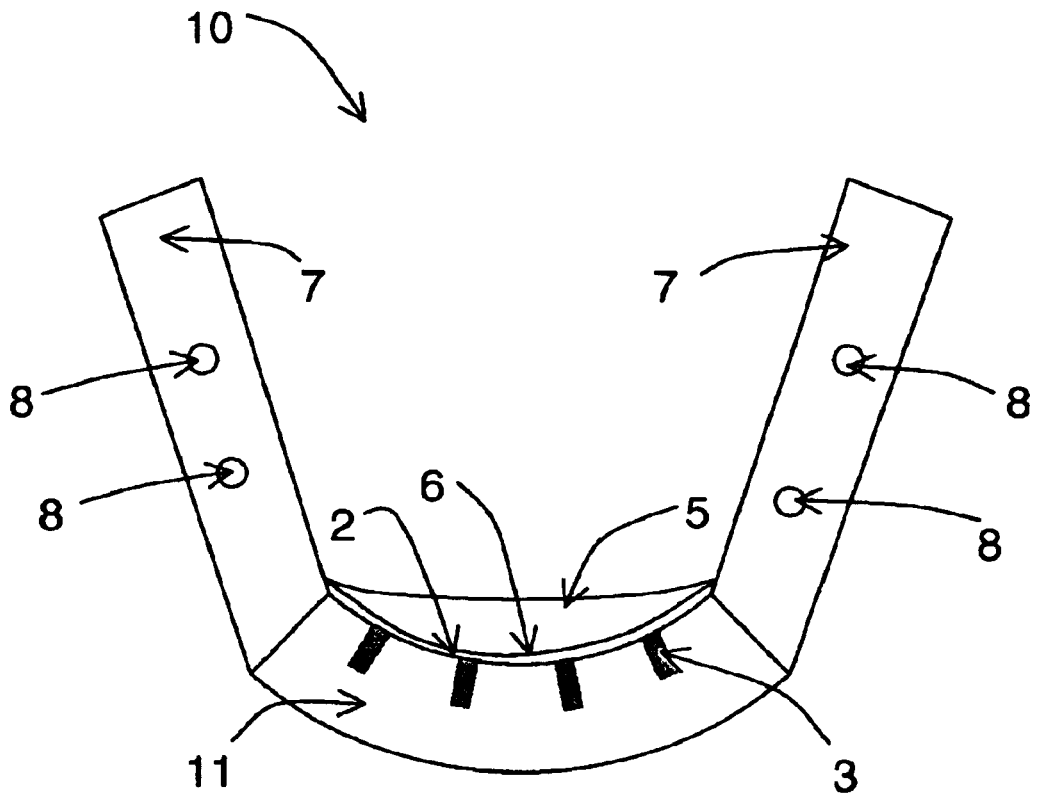

FIG. 1 Cross-sectional illustration of a melt launder according to the invention FIG. 2 Cross-sectional illustration of a melt launder according to another embodiment of to the invention FIG. 3 Cross-section illustration of a melt launder according to a preferred embodiment of the invention In FIG. 1, there is seen a melt launder 1 according to a preferred embodiment of the invention, made of bent copper plate, and on the bottom 2 of said launder there are made grooves 3. The figure is a cross-sectional illustration showing the middle of the melt launder. The number of the grooves 3 made at the bottom of the copper plate can be any desired number, at least one. At the launder bottom, the grooves are placed in an uncooled area, i.e. between the lowest cooling channels. The grooves can be made either in connection with casting, or by making them in the ready-made launder. According to this preferred embodiment, the grooves provided nearest to the edges cannot be located nearer than 30 mm from the edge of the cooling channel 8. In shape, the groove can represent any possible form. According to the present embodiment, the grooves are 10–20 mm deep and 10 mm wide, at a distance of 20 mm from each other. Said measures may vary depending on the size of the melt launder. The melt launder comprises a required number of grooves in the lengthwise direction of the launder, in addition to which both ends of the launder are provided with transversal grooves that are not seen in the cross-sectional illustration. Said transversal grooves are made at both ends of the launder, and they extend from one launder edge to the other, so that a longer working age is achieved for the launder. At both ends of the launder, the lengthwise grooves end at a transversal groove. The grooves 3 as well as the transversal grooves are filled with fire-resistant mass that is partly worn away when tapping molten slag 5 and is autogenously replaced by solidified slag 6. At the edges 7 of the launder, there are arranged cooling channels 8; they are placed in an area that is not left under the melt when the melt 5 is being tapped. The cooling channels 8 are manufactured either in connection with slip casting or by drilling lengthwise holes at the edges 7 of a bent copper billet. In the cooling channels, there flows water that prevents excessive heating. A required number of channels is provided.

FIG. 2 shows the end of a melt launder 9 according to another preferred embodiment of the invention, seen in a cross-sectional illustration. It is manufactured by compactly interconnecting two straight plates made of copper or copper alloy, so that the edges 7 and the bottom 2 are made of said plates. Now that area at the bottom 2 that gets into contact with the melt 5 is provided with grooves 3, which are then filled with fire-resistant mass. The melt launder is provided with a necessary amount of grooves 3, proceeding in the lengthwise direction thereof, as well as with two transversal grooves 12 arranged at both ends of the launder. The transversal grooves are made at both ends of the launder, and they extend from one launder edge 7 to the other, so that a longer working life is achieved for the launder. At both ends of the launder, the lengthwise grooves of the launder end in a transversal groove. Partly the grooves are worn away when tapping slag or when cleaning the launder, and they are autogenously replaced by solidified slag 6. The grooves can be made either in connection with casting or by working them in a ready-made launder. The cooling channels 8 are placed at the edges 7 in the lengthwise direction of the melt launder, so that they are not left underneath the melt surface.

FIG. 3 illustrates a preferred embodiment of the invention. The bottom 11 and the edges 7 of the melt launder 10 are manufactured of separate parts. The bottom 11 is bent of metal and provided with grooves 3. The edges 7 made of straight plates are connected to the bottom 11, so that a sufficient compactness and heat transfer are achieved. The melt launder is provided with a required number of grooves in the lengthwise direction thereof, in addition to which both ends of the launder are provided with transversal grooves that are not shown in the cross-sectional illustration. The transversal grooves are made at both ends of the launder, and they extend from one edge of the launder to the other, so that a longer working life for the launder is achieved. At both ends of the launder, the lengthwise grooves end in a transversal groove. The grooves 3 as well as the transversal grooves are filled with a fire-resistant mass that is partly worn away when tapping molten slag 5 and is autogenously replaced by solidified slag 6. The edges 7 are provided with cooling channels 8, located above the melt surface 5.

For a man skilled in the art, it is apparent that the various preferred embodiments of the invention are not restricted to those described above, but may vary within the scope of the appended claims.

What is claimed is:

1. A melt launder for tapping a molten phase from a smelting furnace, the melt launder comprising:

a bottom portion and edge portions, made of copper or copper alloy, for contacting the molten phase, the edge portions being provided with cooling channels situated in a lengthwise direction of the melt launder, above a level the molten phase reaches during use, the bottom portion of the melt launder having at least one groove adapted to hold a fire-resistant material that contacts the molten phase during use.

2. A melt launder according to claim 1, wherein the bottom portion has at least one lengthwise groove and at least one transverse groove extending a width of the melt launder.

3. A melt launder according to claim 1, further comprising a fire-resistant material situated in the at least one groove.

4. A melt launder according to claim 3, wherein the fire-resistant material is a material that is capable of being autogenously replaced by solidified melt.

5. A melt launder according to claim 1, wherein the at least one groove is 5–25 mm deep and 5–25 mm wide.

6. A melt launder according to claim 1, wherein a plurality of grooves are provided, each groove being separated from an adjacent groove by a distance of 5–25 mm.

7. A melt launder according to claim 1, wherein the at least one groove is located a distance of at least 30 mm from a lowermost cooling channel.

8. A melt launder according to claim 1, wherein the bottom portion and edge portions of the melt launder are manufactured from a single bent copper element.

9. A melt launder according to claim 1, wherein the bottom portion and edge portions of the melt launder are manufactured from two straight copper plates, which are worked into a substantially V-shape.

10. A melt launder according to claim 1, wherein the bottom portion and edge portions of the melt launder consist of separate parts.

* * * * *